US006481693B1

(12) United States Patent
Tuominen

(10) Patent No.: US 6,481,693 B1
(45) Date of Patent: Nov. 19, 2002

(54) POWER TRANSMISSION AND BEARING ARRANGEMENT FOR A DRUM

(75) Inventor: Kari Tuominen, Luhtikylä (FI)

(73) Assignee: KCI Konecranes International PLC, Hyvinkää (FI)

( * ) Notice: Subject to any disclaimer, the term of this patent is extended or adjusted under 35 U.S.C. 154(b) by 0 days.

(21) Appl. No.: 09/831,109

(22) PCT Filed: Nov. 3, 1999

(86) PCT No.: PCT/FI99/00918

§ 371 (c)(1),
(2), (4) Date: May 31, 2001

(87) PCT Pub. No.: WO00/27741

PCT Pub. Date: May 18, 2000

(30) Foreign Application Priority Data

Nov. 5, 1998 (FI) ..... 982400

(51) Int. Cl.[7] ..... B66D 1/00
(52) U.S. Cl. ..... 254/266; 254/342
(58) Field of Search ..... 254/266, 342; 242/541, 541.4, 541.5

(56) References Cited

U.S. PATENT DOCUMENTS 617,175 A * 1/1899 Mumford ..... 254/274
2,028,532 A * 1/1936 Treloggen ..... 242/393
2,826,867 A * 3/1958 Nardone ..... 65/229
2,922,623 A * 1/1960 Simmons ..... 188/65.1
5,603,489 A * 2/1997 Regal ..... 254/342
5,607,143 A * 3/1997 Regal ..... 254/342
5,678,452 A * 10/1997 Frazier ..... 254/342
5,816,564 A * 10/1998 Winter ..... 254/266

FOREIGN PATENT DOCUMENTS

| | | |
|---|---|---|
| DE | 909986 | 4/1954 |
| FI | 80250 | 1/1990 |
| GB | 2235916 | 3/1991 |

* cited by examiner

*Primary Examiner*—Emmanuel M. Marcelo
(74) *Attorney, Agent, or Firm*—Birch, Stewart, Kolasch & Birch, LLP

(57) ABSTRACT

The invention relates to a power transmission and bearing arrangement for a drum, the drum (1) being provided for a rope (2) that exerts a tangential force on the circumference of the drum, and the arrangement comprising the mounting of the drum in bearings (7 to 10) to a frame structure (6) and a drive arrangement for rotating the drum, the drive arrangement comprising at least one member (3) that is in drive engagement with the drum surface. To simplify the structure and to eliminate the bending moment acting on the drum, the drum bearing arrangement comprises means (7 to 10) that carry the drum and support the drum surface (1) to the frame structure (6) directly from the outer and inner surfaces (4, 5) of the drum surface, the point where the rope is unwound from the drum being located within the bearing area when seen from the end of the drum.

11 Claims, 2 Drawing Sheets

POWER TRANSMISSION AND BEARING ARRANGEMENT FOR A DRUM

This application is the national phase under 35 U.S.C. § 371 of PCT International Application No. PCT/FI99/00918 which has an International filing date of Nov. 3, 1999, which designated the United States of America and was published in English.

BACKGROUND OF THE INVENTION

The invention relates to a power transmission and bearing arrangement for a drum, the drum being meant for a rope which exerts a tangential force on the circumference of the drum, and the arrangement comprising the mounting of the drum in bearings to a frame structure and a drive arrangement for rotating the drum, the drive arrangement comprising at least one means which is in drive engagement with the drum surface. The drum may be meant for a lifting rope hanging from a lifting apparatus, although other similar applications are also possible.

The conventional way to arrange the power transmission and bearing arrangement of a drum is to provide the drum with a central shaft and bearings and to mount the drum to a frame structure, a drive arrangement being connected to the shaft. When this solution is applied to a lifting apparatus, the speed of the load suspended from the drum and, inversely, the torque in relation to the rate of rotation of the drive motor depend on the diameter of the drum and on the transmission ratio between the gear arranged between the motor and the drum and the cordage associated with the drum. Since economical manufacturing costs are to be aimed at, the drum diameter must be minimized to maintain a low transmission ratio in the gear. A small drum diameter, on the other hand, exposes the rope to wear.

Another alternative is to use the above described drum comprising the central shaft and mounted in the shaft bearings to the frame structure, only in such a way that the drive wheel of the drive arrangement is arranged to be in drive engagement with the drum surface, thus providing an additional transmission ratio in the power transmission of the drum, in addition to the transmission provide by the gear and the ropes. The magnitude of the transmission concerned is approximately equal to the magnitude of the portion by which the drum diameter reduces transmission, the drum diameter thus having no impact on the total transmission ratio. In this solution the drive wheel of the drum is usually placed on the circumference of the drum rearward from the spooling point of the rope by an amount equal to the pressure angle, thereby ensuring that the gear load and the rope force cancel each other as effectively as possible.

A problem with the above-mentioned solutions is that the method of arranging the drum bearing subjects the frame structure not only to rope force but also to a bending moment. In addition, when the drive is arranged directly on the drum surface, the frame structure must be made robust because the gear load cannot be completely cancelled and the accuracy of the shaft length must be guaranteed.

BRIEF DESCRIPTION OF THE INVENTION

An object of the present invention is to remove the above drawbacks, starting from the type of arrangement described at the beginning. This is achieved with a method of the invention, characterized in that the means in drive engagement is substantially located, when seen in the circumferential direction of the drum surface, in an area on the other side of the drum surface between the means arranged to support and carry the drum surface, or substantially located on the other side of the drum surface at the means arranged to support and carry the drum surface, and that, seen from the end of the drum, the only point where the rope is unwound from the drum is located within the bearing area.

The invention is based on the idea that rope forces are led directly to the frame structures, thus providing light-weight and simple-structured frame parts. The lifting apparatus must naturally be attached to and/or suspended from the area where the rope unwound from the drum.

Due to the advantageous transmission ratio, a large drum diameter can be selected. This not only extends the service life of the rope but also allows a particular rope length (lifting height) to be obtained by a shorter drum, which reduces the drifting of the rope. A rope is said to drift when the spooling point of the rope on the drum shifts in the axial direction of the drum when the rope is wound on or off the drum. This also causes angles in the cordage that wear the rope and the rope grooves, and requires a wider suspension.

Other advantages of the invention are the possibility to make the structure of the lifting apparatus both compact and simple to manufacture and to assemble. In addition, different trolley arrangements are easy to attach to the frame, and the drive arrangement can be more freely selected and positioned than before.

Preferred embodiments of the invention are described in the independent claims.

BRIEF DESCRIPTION OF THE DRAWINGS

In the following the invention will be described in greater detail in connection with preferred embodiments and with reference to the accompanying drawings, in which.

DETAILED DESCRIPTION OF THE INVENTION

Figure 1:
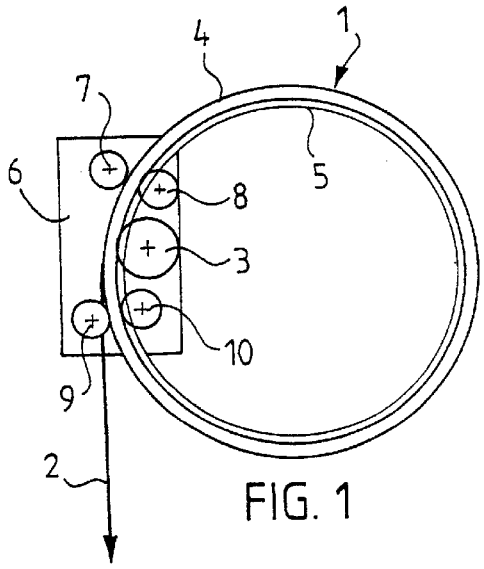
FIG. 1 is a schematic view illustrating a power transmission and bearing arrangement of the invention in connection with a drum.

With reference to FIG. 1, a centerless, hollow cylindrical drum 1 of a lifting apparatus is illustrated, a lifting rope 2 being wound on the drum and hanging down from it. A drive wheel of a drive arrangement rotating the drum 1 is indicated with reference numeral 3. The drum 1, i.e. the drum surface, is mounted in bearings to a frame structure 6 directly on inner and outer surfaces 4, 5 of the drum. The bearing arrangement carrying and supporting the drum surface 1 comprises, at both ends of the drum surface 1, one pair of bearings 7, 8 and 9, 10 arranged above and below the drive wheel 3 in drive engagement with the drum surface 1, each pair of bearings 7, 8 and 9, 10 comprising a bearing 7, 9 supporting the outer surface 4 of the drum surface 1 and a bearing 8, 10 supporting the inner surface 5 of the drum surface 1. The rope 2 is unwound from the drum 1 in an area between the upper and lower bearings, the forces caused by the rotating of the drum 1 and the rope 2 thus being directly led to the frame structure 6, without the frame structure 6 being subjected to a bending moment.

Figure 2:
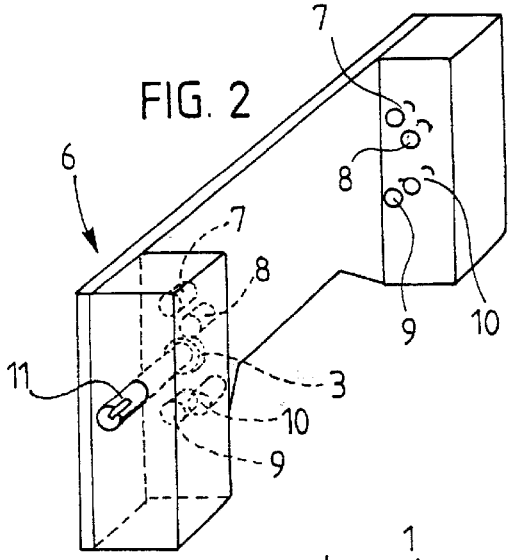
FIG. 2 is a perspective view illustrating a frame structure implemented in accordance with the principle illustrated in FIG. 1 and provided with bearing and power transmission arrangements.

FIG. 2 shows the contact between the above described arrangement and the frame structure 6 in greater detail. A drive shaft associated with the drive wheel 3 is indicated with reference numeral 11. As regards the drive arrangement, the drawings only show the drive wheel 3 and its drive shaft because the gear of the drive arrangement and the motor associated with the gear can be selected among several different types of solutions that can be placed in various alternative ways. For example, the gear may be a sleeve gear, and the motor may be arranged inside the drum 1, whereby the lifting apparatus can be made shorter.

Figure 3:
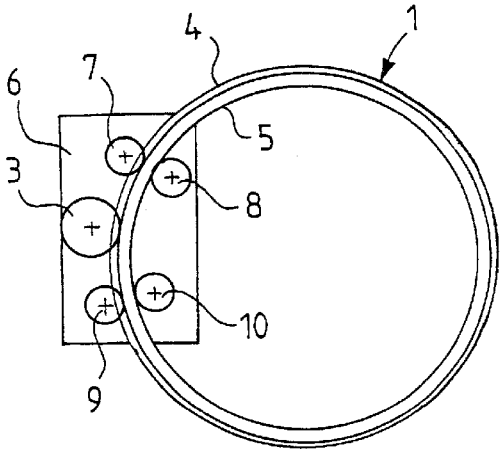
FIGS. 3 to 7 illustrate alternative power transmission and bearing arrangements of the invention in connection with a drum.

In FIGS. 2 and 3 the drive wheel 3 is in drive engagement with the inner surface 5 of the drum surface 1, but in many cases it may be more advantageous that the drive wheel 3 is in drive engagement with the outer surface 4 of the drum surface, as shown in FIG. 3, because then the transmission ratio of the drive wheel 3 with respect to the drum surface 1 can be increased and the toothing needed on the drum surface 1 is easier to provide on the outer surface 4. When necessary, a second drive wheel can be arranged at the other end of the drum. In addition, the drive wheel 3 can receive some of the bearing load, particularly if a drive wheel is arranged at both ends of the drum 1. If the drum 1 is provided with a drive wheel 3 at both ends, the drive wheels can be interconnected for example by means of a shaft 21 shown in FIG. 8.

The frame structure 6 can be attached to a low trolley (not shown), for example, and the wheels bearing the trolley can be fastened directly to the frame structure 6.

Figure 4:
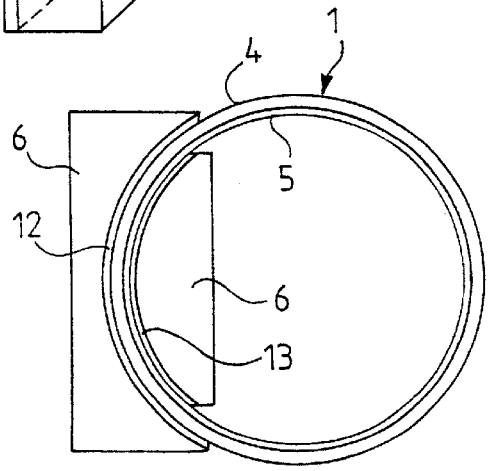

FIG. 4 shows an alternative bearing arrangement for the drum surface 1, the arrangement comprising bearing strips or bands 12 and 13, each of which comprises at least one bearing strip 12 supporting the outer surface 4 of the drum surface 1 and at least one bearing strip 13 supporting the inner surface 5 of the drum 1. The sides of the bearing strips 12 and 13 are fastened to a frame structure not shown in the Figure.

Figure 5:
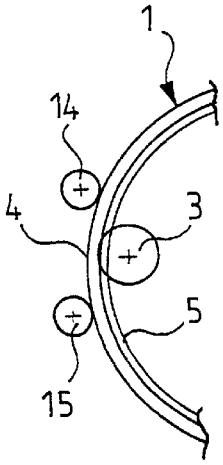

FIG. 5 is a schematic view illustrating a power transmission and bearing arrangement in which the bearing comprises a bearing 14 and 15 supporting the outer surface 4 of the drum surface 1 and arranged at both ends of the drum surface 11 the bearings being arranged above and below the drive wheel 3 which is in drive engagement, at both ends of the drum surface 1, with the inner surface 5 of the drum surface 1, the drive wheel 3 thus forming part of the bearing arrangement of the drum surface 1.

Figure 6:
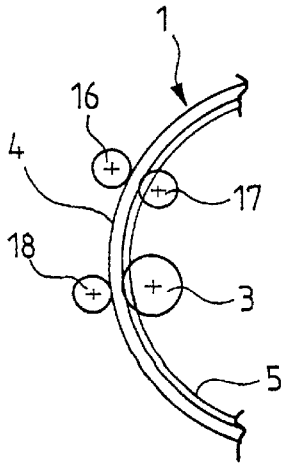

In the application shown in FIG. 6 the bearing arrangement of the drum surface 1 comprises a pair of bearings 16, 17 supporting the outer and inner surfaces 4, 5 of the drum surface 1 at both ends of the drum surface 1, the pair being arranged above the drive wheel 3 in drive engagement with the drum surface 1 at both ends of the drum surface, and bearings 18 arranged to support the drum surface 1 opposite to the drive wheel 3, the drive wheels 3 forming part of the bearing arrangement of the drum 1, similarly as in FIG. 5.

Figure 7:
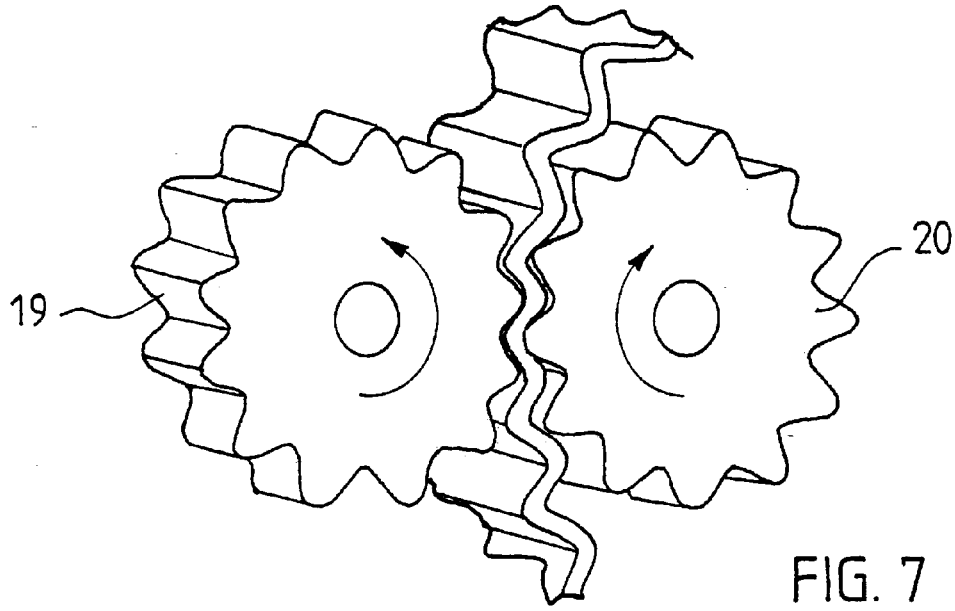

FIG. 7 shows yet another application where the drive arrangement comprises, at both ends of the drum surface 1, both a drive wheel 19 in drive engagement with the outer surface 4 of the drum surface 1 and a drive wheel 20 in drive engagement with the inner surface 5 of the drum surface 1, the drive wheels forming at least part of the drum bearing arrangement.

Figure 8:
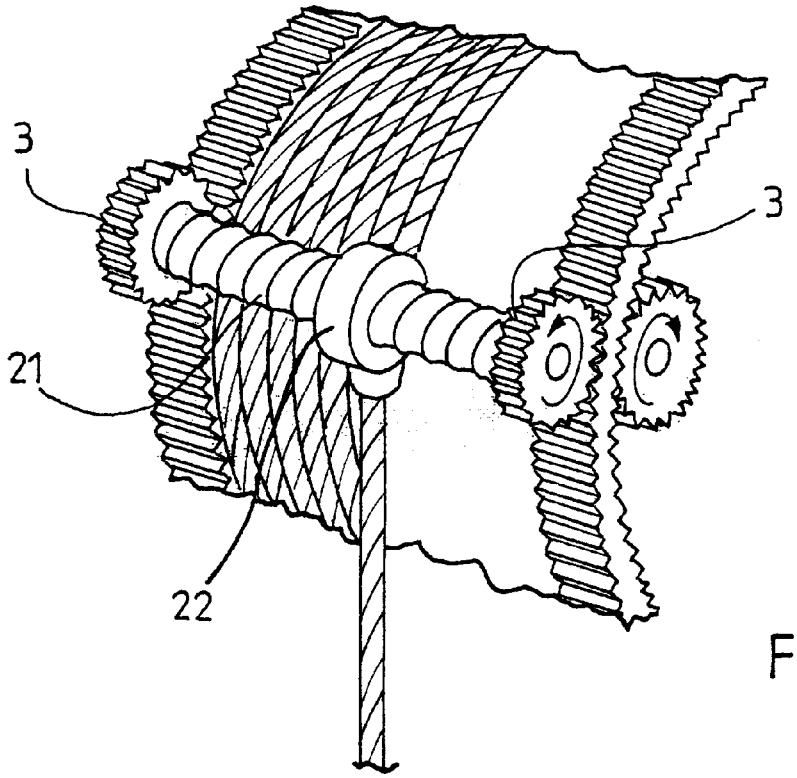
FIG. 8 illustrates an example of the guiding of a rope on a drum.

The centerless bearing arrangement of the drum 1 and the drive of the drum allow different lifting heights to be obtained by changing the drum diameter, other structural changes being not needed. The drum 1 could be manufactured for instance by rolling a long toothed band which is then cut into pieces according to a particular drum diameter. A rope groove can also be profiled onto the drum 1, when needed, at the same time when a blank of the drum band is being rolled. As shown in FIG. 8, the guiding of the rope can also be integrated at the drive wheels 3 interconnected by a shaft 21 provided with a rope guide 22 which is arranged to move by impact of threads made on the shaft 21 and on the rope guide 22.

The above description of the invention is only meant to illustrate the basic idea of the invention. A person skilled in the art may, however, apply the idea to implement details of the invention in various alternative ways within the scope of the appended claims.

What is claimed is:

1. A power transmission and bearing arrangement for a drum, the drum being meant for a lifting rope of a lifting apparatus, the rope exerting a tangential force on the circumference of the drum, and the arrangement comprising the mounting of the drum in bearings to a frame structure and a drive arrangement for rotating the drum, the drive arrangement comprising at least one means which is in drive engagement with the drum surface, and the drum bearing arrangement comprising means carrying the drum and supporting the drum surface directly to the frame structure on the inner and outer surfaces of the drum, wherein the means in drive engagement is substantially located, when seen in the circumferential direction of the drum surface, in an area on the other side of the drum surface between the means arranged to support and carry the drum surface, or substantially located on the other side of the drum surface at the means arranged to support and carry the drum surface, and that, seen from the end of the drum, the only point where the rope is unwound from the drum is located within the bearing area.

2. An arrangement according to claim 1, wherein the bearing arrangement of the drum comprises, at both ends of the drum, at least one pair of bearings arranged, when seen in the circumferential direction of the drum, on both sides of the means in drive engagement with the drum surface, each pair of bearings comprising a bearing supporting the outer surface of the drum surface and a bearing supporting the inner surface of the drum surface.

3. An arrangement according to claim 1, wherein the bearing arrangement of the drum comprises bearing strips arranged at both ends of the drum, the bearing strips comprising at least one bearing strip supporting the outer surface of the drum surface and at least one bearing strip supporting the inner surface of the drum surface.

4. An arrangement according to claims 1, wherein the means in drive engagement with the drum surface is in drive engagement with the outer surface of the drum surface.

5. An arrangement according to claims 1, wherein the means in drive engagement with the drum surface is in drive engagement with the inner surface of the drum surface.

6. An arrangement according to claim 1, wherein the bearing arrangement of the drum comprises, at both ends of the drum surface and, when seen in the circumferential direction of the drum, on both sides of the means in drive engagement with the inner surface of the drum surface at least one bearing supporting the outer surface of the drum surface at both ends of the drum surface, the means in drive engagement thus forming part of the drum bearing arrangement.

7. An arrangement according to claim 1, wherein the bearing arrangement of the drum surface comprises, at both ends of the drum surface, at least one pair of bearings supporting the outer and inner surfaces of the drum surface, when seen in the circumferential direction of the drum, on one side of means in drive engagement with the inner or outer surface of the drum surface at both ends of the drum surface; and bearings supporting the drum surface on the opposite side of the means in drive engagement with the drum surface, the means in drive engagement thus forming part of the bearing arrangement of the drum.

8. An arrangement according to claim 1, wherein the drive arrangement comprises, at both ends of the drum surface, at least one means which is in drive engagement with the outer surface of the drum surface and at least one means which is in drive engagement with the inner surface of the drum surface, the means forming at least part of the bearing arrangement of the drum.

9. An arrangement according to claim 1, wherein the drum is a hollow cylindrical piece.

10. An arrangement according to claim 9, wherein the drum in made of a plate material provided with the necessary profiling by means of rolling.

11. An arrangement according to claim 9, wherein at least part of the drive arrangement is placed inside the drum.

* * * * *